United States Patent [19]

Guidoni

[11] 4,031,900

[45] June 28, 1977

[54] BRASSIERE ADJUSTABLE IN HEIGHT, IN PARTICULAR FOR BATHING SUITS

[76] Inventor: Christian Guidoni, Immeuble "Le Plein Horizon" 62 Chemin du Bois, Rillieux la Pape, Rhone, France

[22] Filed: June 14, 1974

[21] Appl. No.: 479,536

[30] Foreign Application Priority Data

June 15, 1973 France ..... 73.22580

[52] U.S. Cl. ..... 128/493; 128/495; 128/502; 128/510; 2/67

[51] Int. Cl.[2] ..... A41C 3/00; A41D 7/00

[58] Field of Search ..... 128/456, 484, 485, 488, 128/489, 490, 491, 492, 493, 502, 506, 508, 510, 425; 2/67

[56] References Cited

UNITED STATES PATENTS

| | | | |
|---|---|---|---|
| 1,874,868 | 8/1932 | Bissett | 128/491 |
| 1,886,416 | 11/1932 | Monroe | 2/67 |
| 2,484,467 | 10/1949 | Schacht | 128/493 |
| 2,520,225 | 8/1950 | Scott-Elliot | 128/491 |
| 2,651,040 | 9/1953 | Block | 128/489 X |

FOREIGN PATENTS OR APPLICATIONS

| | | | |
|---|---|---|---|
| 899,693 | 6/1945 | France | 128/482 |
| 786,935 | 9/1935 | France | 128/510 |
| 1,009,390 | 5/1952 | France | 128/510 |

*Primary Examiner*—Werner H. Schroeder
*Attorney, Agent, or Firm*—Irving M. Weiner; Pamela S. Austin

[57] ABSTRACT

A brassiere including two pouches which are connected to each other at the neckline by means of a tie which slides inside tubular hems of the pouches. Strings slide within tubular hems on the outer sides of the pouches of the brassiere, the position of which with respect to the armpits of the wearer, as well as the height and depth of the pouches, being adjustable by such strings sliding freely inside the tubular hems.

9 Claims, 5 Drawing Figures

BRASSIERE ADJUSTABLE IN HEIGHT, IN PARTICULAR FOR BATHING SUITS

The present invention relates to a brassiere, particularly for a two-part bathing suit.

BACKGROUND OF THE INVENTION

It is known that women encounter some inconveniences with bathing suits which cannot be adapted to the outlines of their breasts. In spite of all the care taken in buying a bathing suit, the latter must often be provided then with pleats, that is, permanent seams, in order to fit the breast properly, so that for a given brassiere the area of skin covered by the pouches is definitely set.

In bathing suits this has a drawback when a user, who is already tanned by a long exposure to sun, wants to put on another bathing suit, as certain skin areas which were not exposed initially appear then as pale spots between the new brassiere and the sunburnt skin areas.

An object of the present invention is to obviate such drawbacks by providing a brassiere with pouches which are adjustable as regards both the height and the depth thereof, so as to fit the figure of the user and allow modifying the skin area covered.

SUMMARY OF THE INVENTION

The present invention provides a brassiere comprising a first fabric piece having tubular hems on opposite edges thereof, and a second fabric piece having tubular hems at opposite edges thereof. The brassiere also includes first means slidably disposed through a tubular hem of the first fabric piece and through a tubular hem of the secondary fabric piece for adjustably interconnecting the first and second fabric pieces at adjacent edges thereof. The brassiere also includes second means slidably disposed through the other tubular hem of the first fabric piece and through the other tubular hem of the second fabric piece of adjustably interconnecting the first and second fabric pieces at the remote edges thereof.

A brassiere according to the invention is constituted by two surfaces of fabric corresponding each to one pouch and connected to each other at the neckline. It is characterized in that each of said surfaces includes at least a first hem which defines a tubular section open at both ends, inside which a portion of a tie can slide freely, the other portion of said tie sliding freely inside the first tubular hem of the other surface, so as to connect the two pouches of the brassiere, and a second hem which defines a tubular section inside which a string slides freely, the two ends of said string being respectively connected to the two ends of the string which slides inside the second hem of the other surface of fabric, said tie and said two strings constituting the means for positioning the brassiere and adjusting the skin area to be covered.

According to a first embodiment, the tie which slides inside a hem of the two pouches is a textile band which is closed on itself by a knot, which knot defines a loop the periphery of which is adjustable depending on the position of the tightening point, while the inner hem of each pouch inside which said tie slides is substantially vertical.

According to modified embodiments, the two pouches are united through a closed band, which may be elastic or rigid and have a circular, or square outline, for instance.

According to another feature of the invention, the surfaces of fabric which constitute each of the pouches of the brassiere have, when laid flat, substantially square or rectangular shapes. Tubular hems border the vertical sides. The upper horizontal side is defined by a flat seam, while the lower horizontal side has a hem inside which an elastic means, such as, for instance, a rubber thread, is provided, which is, connected to the fabric near the corners of the square or rectangular surface.

According to another feature of the invention, the fabric is elastic at least in the direction of the width of the brassiere.

According to another feature, the height of the pouches varies depending on the diameter of the loop defined by the tie, while forming substantially horizontal puckers which cause the depth of the pouches and the area of skin covered by the the brassiere to be reduced. This adjustment may also be carried out by bringing the upper and lower edges of the lateral hems closer to or further from each other.

According to another feature of the invention, the upper ends of the strings inside the lateral hems are tied together behind the neck of the user, the distance between this connection point and the upper edges of the pouches being adapted to be adjusted so that the brassiere fits the figure of the user, while the lower ends of said strings are tied together on the back of the user.

It will thus be seen that the brassiere according to the invention allows adjusting the free height under the armpits of the user, and modifying the area of skin covered according to the desire of the user. Obviously, the strings may be made in various ways (weaving, braiding, knitting). The ends of said strings may be provided with adjustable sliding buckles, which may replace the knots previously described.

DETAILED DESCRIPTION

Figure 1:
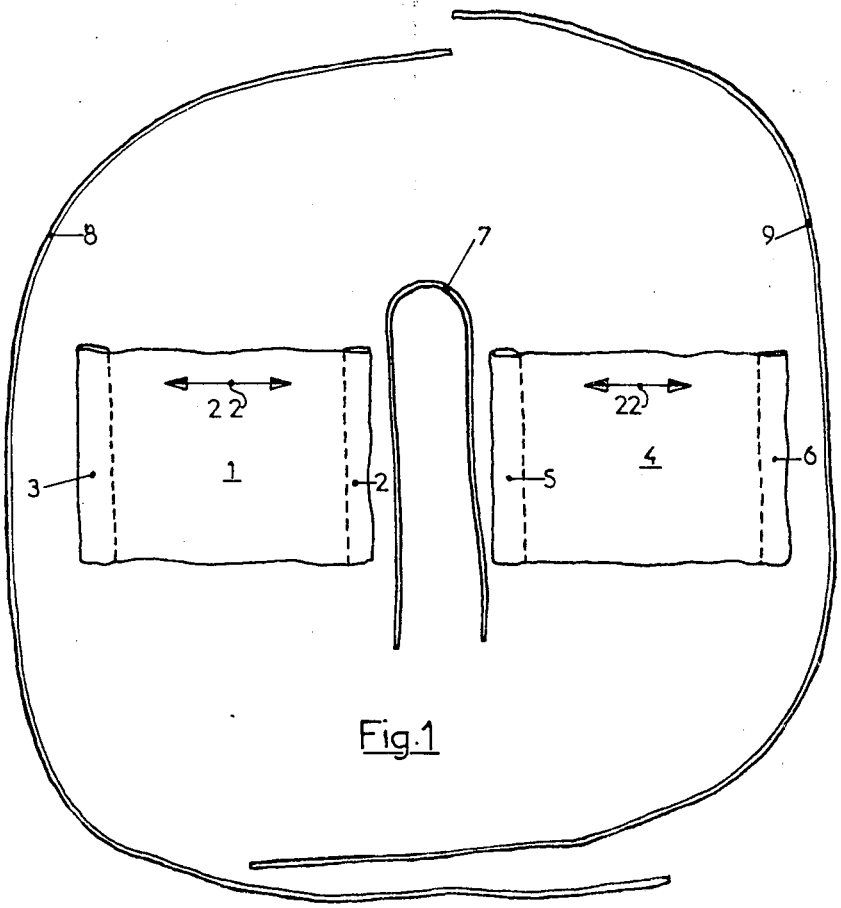
FIG. 1 is an exploded front view of the elements of a brassiere according to the invention.

FIG. 1 shows the component parts of a brassiere according to the invention. The latter includes two substantially rectangular pieces 1 and 4 of a fabric which is elastic at least in the directions of the double arrow 22. These two pieces of fabric constitute each one of the pouches of the brassiere. They are connected to each other through first means, such as a tie 7, which slides inside hems 2 and 5 each provided on one of the opposite sides of the pouches. The tubes defined by the hems 2 and 5 are open at each one of their ends. Second means, such as strings 8 and 9, slide inside tubular hems 3 and 6, which are similar to the hems 2 and 5 and provided on the outer side of each of the pouches. Said strings are generally made of a textile material which is woven or knotted so as to be substantially unextensible in the longitudinal direction.

Figure 2:
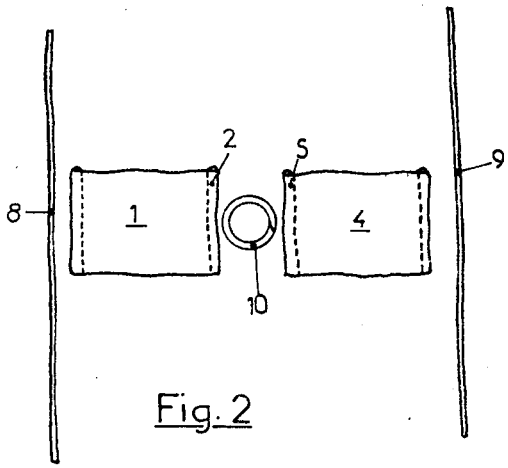
FIG. 2 is a front view of a modified embodiment of the brassiere according to the invention.
Figure 4:
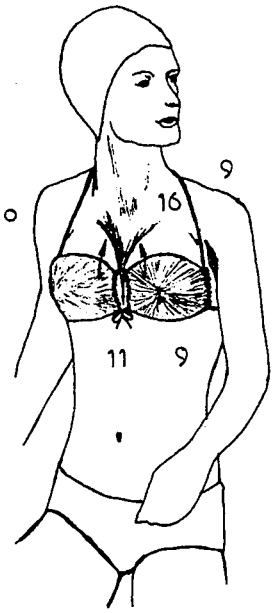
FIGS. 4 and 5 are views of the same brassiere, adjusted with pouches of a maximum height, and with pouches of a reduced height, respectively.

FIG. 2 shows a modification, wherein the flexible tie 7 is replaced by a rigid circular ring 10 adapted to be inserted in the hems 2 and 5 to slide therein.

Figure 3:
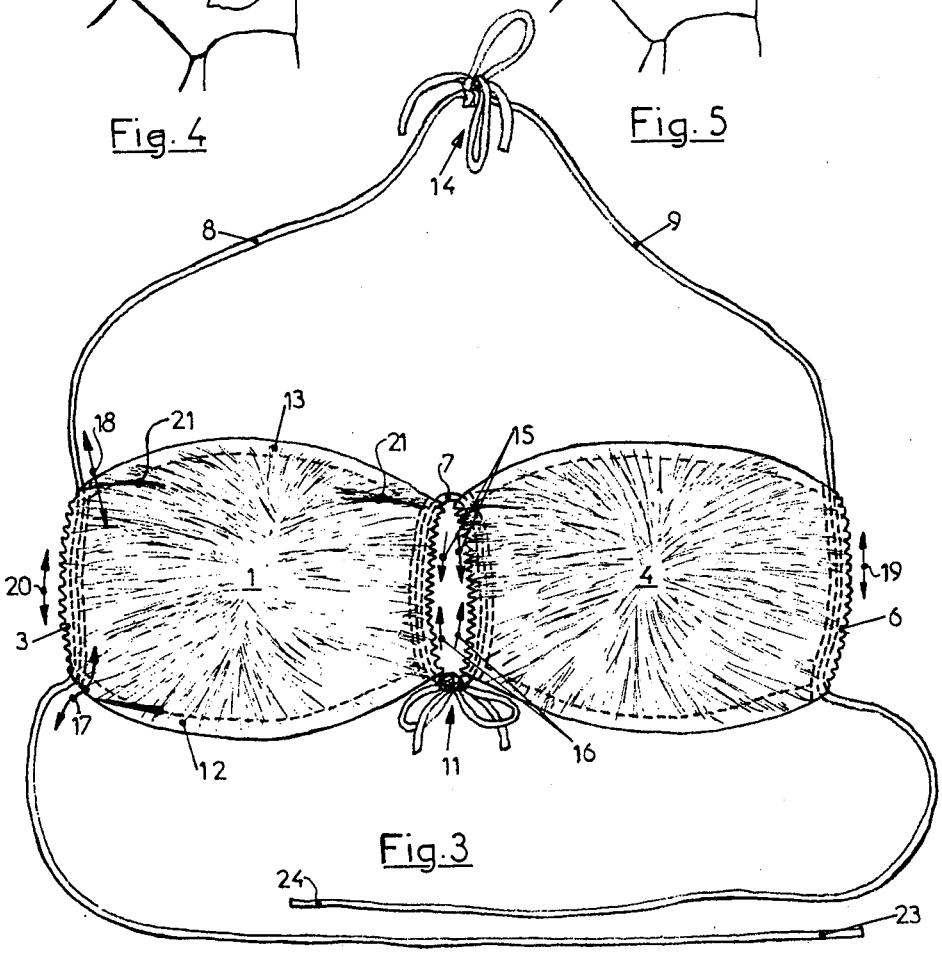
FIG. 3 is a perspective view of a brassiere corresponding to the elements shown in FIG. 1.

The brassiere according to the invention is used as follows:

With reference to FIG. 3, the strings 8 and 9 are inserted into the tubes 3 and 6 respectively, of the pouches 1 and 4. The tie 7 is inserted into the hems 2 and 5, and closed on itself by its two ends being tied together. To this end, the two free ends of the tie 7 are tied into a knot 11, the position of which on the length of the tie 7 is easily adjustable. Said position sets, at the will of the user, the height of the loop thus formed. On the other hand, the strings 8 and 9 are connected to each other through a knot 14 disposed towards the upper ends of said strings (FIG. 3).

Figure 5:
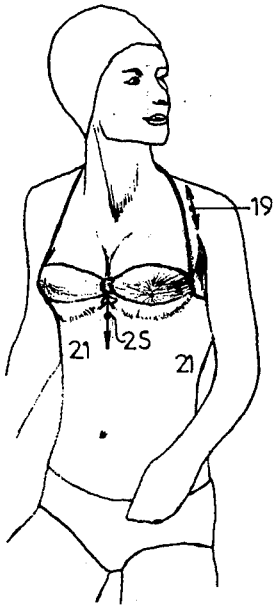

It will be seen that the relative sliding of the strings 8 and 9 and the tie 7, on the one hand, and of the pouches 1 and 4, on the other hand, allows effecting the following independent adjustments:

a. positioning the brassiere as a function of the figure of the user. As a matter of fact, the "necklace" obtained by tying the upper portions of the strings 8 and 9 at 14 is passed behind the neck of the user. The latter brings the pouches 1 and 4 to a suitable position by sliding them in the directions of the double arrows 19 and 20. The lower ends 23 and 24 of the strings 8 and 9 are then tied together on the back of the user. This double sliding allows thus adjusting the height of the brassiere under the armpits, so that the selection of the size when buying a bathing suit with a brassiere according to the invention is less critical than when buying a bathing suit with a non-adjustable brassiere; and b. adjusting and modifying the height and depth of the pouches 1 and 4. This may be achieved in two different ways. The first way consists of reducing the length of the loop defined by the tie 7, by sliding said tie in the direction of the arrows 15, while moving the knot 11 away from the ends of said tie. Such tightening generates substantially horizontal puckers 21 in the fabric of the pouches. Said puckers replace the permanent plaits of the known systems and decrease the depth of each pouch, so that the user is able to adapt her brassiere to the volume of her breast, or reduce the area of skin covered, in order to obtain, for instance, a maximum of suntanning (FIG. 5).

The reverse operation, that is, lengthening (arrow 16) the loop defined by the tie 7, produces contrary results. The number of horizontal puckers decreases, the distance between the upper and lower edges of each pouch increases, as well as the depth of each pouch. This allows adapting the brassiere to a plumper breast, or increasing the area of skin which is to be protected from the sun.

c. when the central tie is a rigid sliding tie, such as, for instance, a ring 10 (FIG. 2), the adjustment of the height and depth of the pouches is carried out by modifying the distance between the upper edges and the lower edges of the hems on the inner side of each pouch through a sliding displacement in the direction of the double arrows 17 and 18 (FIG. 3). This adjustment may be combined, besides, with the adjustment by means of the central tie (FIG. 3).

I claim:

1. A brassiere comprising, in combination:

first and second separate and individually and independently movable and adjustable fabric pieces;

said first fabric piece having tubular hems at opposite edges thereof;

said second fabric piece having tubular hems at opposite edges thereof;

said first and second fabric pieces comprising two surfaces of fabric which constitute pouches each of which has a substantially rectangular shape on which said tubular hems border the vertical sides thereof, and on which the upper horizontal side thereof is provided with a flat seam, and on which the lower horizontal side thereof has a hem inside of which an elastic means is provided;

said elastic means being connected to the fabric near the corners of said rectangular surface;

first means slidably disposed through a tubular hem of said first fabric piece and through a tubular hem of said second fabric piece for independently adjustably and removably interconnecting said first and second fabric pieces at adjacent edge thereof and for providing an adjustable and variable space between said adjacent edges of said first and second separate and individually and independently movable and adjustable fabric pieces;

a first elongated member slidably disposed through the other tubular hem of said first fabric piece;

a second elongated member slidably dispoed through the other tubular hem of said second fabric piece; and the two ends of said first elongated member being removably and adjustably connected to the two ends of said second elongated member for independently adjustably and removably interconnecting said first and second fabric pieces at the remote edges thereof and for facilitating easy removal of said brassiere from the wearer thereof.

2. A brassiere according to claim 1 wherein said first and second pieces comprise two surfaces of fabric corresponding each to a pouch and connected to each other at the neckline, said first means comprises a tie, said first and second elongated members comprises two strings, each of the surfaces includes at least a first hem defining a tubular section open at both ends, inside which a portion of said tie slides freely, the other portion of said tie sliding freely inside the first tubular hem of the other surface, so as to connect the two pouches of the brassiere to each other, and a second hem having a tubular section inside which one of said strings slides freely, the two ends of said string being respectively connected to the two ends of the other string which slides inside the second hem of the other surface of fabric, the tie and the two strings constituting the means for positioning the brassiere and adjusting the height of the skin area to be covered.

3. A brassiere according to claim 2, characterized in that the tie slides inside the inner and substantially vertical hem of each of the two pouches, said tie being a textile band closed on itself by a knot so as to define a loop, the perimeter of which is adjustable depending on the position of the tightening point.

4. A brassiere according to claim 2, characterized in that the two pouches are connected to each other by a rigid tie adapted to slide inside the inner hems.

5. A brassiere according to claim 2 characterized in that the fabric is elastic at least in the direction of the width of the brassiere.

6. A brassiere according to claim 2 characterized in that the height of the pouches can be modified as a function of the diameter of the loop defined by the tie, on the one hand, and as a function of the distance between the upper and lower edges of the lateral hems, on the other hand, this adjustment generating substantially horizontal puckers which cause the depth of the pouches and the area of skin covered by the brassiere to be reduced.

7. A brassiere according to claim 2 characterized in that the upper ends of the strings sliding inside the lateral hems are tied together behind the neck of the user, the distance between said tying point and the upper edges of the pouches being adapted to be adjusted to fit the brassiere to the figure of the user, while the lower ends of said strings are tied together on the back of the user.

8. A brassiere according to claim 2 characterized in that the adjustments enable it to be adapted to different figures, while a user is able easily to adjust the position of the pouches and modifying the area of skin not to be exposed to the sun.

9. A brassiere according to claim 1 wherein said first and second members includes two elongated members the ends of which are adapted to be removably secured to each other.

* * * * *